US008893590B2

(12) United States Patent
Chen

(10) Patent No.: US 8,893,590 B2
(45) Date of Patent: Nov. 25, 2014

(54) RATCHET WRENCH WITH ADJUSTABLE CLAMPING SIZE

(71) Applicant: Infar Industrial Co., Ltd., Chang-Hwa (TW)

(72) Inventor: Ander Chen, Chang-Hwa (TW)

(73) Assignee: Infar Industrial Co., Ltd., Chang-Hwa (TW)

( * ) Notice: Subject to any disclaimer, the term of this patent is extended or adjusted under 35 U.S.C. 154(b) by 125 days.

(21) Appl. No.: 13/792,007

(22) Filed: Mar. 9, 2013

(65) Prior Publication Data

US 2014/0251089 A1 Sep. 11, 2014

(51) Int. Cl.
*B25B 13/52* (2006.01)
*B25B 13/46* (2006.01)
*B25B 13/10* (2006.01)

(52) U.S. Cl.
CPC ..... *B25B 13/462* (2013.01); *B25B 13/10* (2013.01)
USPC ..... 81/63.1; 81/60; 81/61; 81/62; 81/63; 81/63.2

(58) Field of Classification Search
USPC ..... 81/60–63.2
See application file for complete search history.

(56) References Cited

U.S. PATENT DOCUMENTS

| | | | | |
|---|---|---|---|---|
| 908,595 | A * | 1/1909 | Moffett | 81/62 |
| 3,377,893 | A * | 4/1968 | Shorb | 81/113 |
| 4,663,999 | A * | 5/1987 | Colvin | 81/128 |
| 5,893,306 | A * | 4/1999 | Owoc | 81/60 |
| 7,261,021 | B1 * | 8/2007 | Carnesi | 81/128 |
| 2006/0086211 | A1 * | 4/2006 | Johnson | 81/128 |

* cited by examiner

*Primary Examiner* — Monica Carter
*Assistant Examiner* — Danny Hong
(74) *Attorney, Agent, or Firm* — Banger Shia

(57) ABSTRACT

A ratchet wrench adjustable in clamping size is provided with a body, a ratchet wheel, an adjustment member, two engaging members and a spring. The body includes a head portion, a handle and a switch member. The two engaging members are oppositely located on the ratchet wheel and the adjustment member and each include an engaging portion, a neck portion connected to the engaging portion and located in the ratchet wheel, and an upper portion connected to the neck portion and located in the adjustment cavity of the adjustment member. By such arrangements, rotating the rotating portion of the adjustment member adjusts relative positions of the upper portions of the two engaging members in the adjustment cavity of the adjustment member, and makes the neck portions of the engaging members to move along the guide slot so as to change a distance between the two engaging portions.

9 Claims, 11 Drawing Sheets

RATCHET WRENCH WITH ADJUSTABLE CLAMPING SIZE

BACKGROUND OF THE INVENTION

1. Field of the Invention

The present invention relates to a ratchet wrench, and more particularly to a ratchet wrench with adjustable clamping size.

2. Description of the Prior Art

Referring to FIGS. 1 and 2, a conventional ratchet wrench comprises a ratchet wheel 12 and a switch device 13 which are disposed in a head portion 11 of the ratchet wrench. The switch device 13 is provided with two engaging members 131, 132, two springs 133, a switch member 134 which are disposed in the head portion 11, and a turning member 135 which is located outside the head portion 11 to turn the switch member 134. The ratchet wheel 12 is formed with an engaging cavity 121 to engage with a bolt 14 to be rotated.

When the ratchet wrench needs to apply a torque only in a counterclockwise direction, the user can turn the turning member 135 to rotate the switch member 134 in counterclockwise direction, as shown in FIG. 2, so that the switch member 134 pushes the right engaging member 131 to make it disengage from the ratchet wheel 12 and make the left engaging member 132 engage with the ratchet wheel 12. By such arrangements, the ratchet wheel 12 is only able to idly rotate in the clockwise direction, namely, the ratchet wrench is only able to apply a unidirectional torque.

However, this ratchet wrench is only able to switch rotation direction but unable to fit different sized bolts 14, in other words, the engaging cavity 121 of the ratchet wheel 12 is fixed and only able to match with a specific sized bolt 14.

The present invention has arisen to mitigate and/or obviate the afore-described disadvantages.

SUMMARY OF THE INVENTION

The primary objective of the present invention is to provide a ratchet wrench which is adjustable in clamping size to fit different fasteners to be rotated.

To achieve the above objective, a ratchet wrench with adjustable clamping size in accordance with the present invention comprises: a body, a ratchet wheel, an adjustment member, two engaging members and a spring. The body of the ratchet wrench includes a head portion, a handle connected to the head portion and a switch member disposed at the head portion. The ratchet wheel is pivotally disposed in the head portion and provided with a ratchet portion for engaging with the switch member, a pivot cavity with a bottom, and a guide slot formed in the bottom of the pivot cavity. The adjustment member is pivotally disposed in the pivot cavity and includes a rotating portion and a non-circular adjustment cavity located toward the guide slot. The two engaging members are oppositely located at two opposite sides of the ratchet wheel and the adjustment member and each include an engaging portion, a neck portion connected to the engaging portion and located in the guide slot of the ratchet wheel, and an upper portion connected to the neck portion and located in the adjustment cavity of the adjustment member. The upper portion is engaged with an inner surface of the adjustment cavity. The spring is disposed between the upper portions of the two engaging members to make the upper portion engaged with an inner surface of the adjustment cavity. By such arrangements, rotating the rotating portion of the adjustment member adjusts relative positions of the upper portions of the two engaging members in the adjustment cavity of the adjustment member, and makes the neck portions of the engaging members to move along the guide slot so as to change a distance between the two engaging portions.

Preferably, the adjustment member is further provided on the inner surface of the adjustment cavity of the adjustment cavity with two opposite first engaging grooves and two opposite second engaging grooves in such a manner that a distance between the two first engaging grooves is larger than a distance between the second engaging grooves, and each of the engaging members is further provided with a protrusion which is formed on an outer surface of each of the upper portions to selectively engage with the first engaging grooves or the second engaging grooves.

Preferably, each of the engaging members is further provided with a receiving cavity formed on an inner surface of each of the upper portions.

Preferably, the guide slot of the ratchet wheel includes a first section and two second sections which extend from two ends of the first section and have a diameter smaller that a diameter of the first section, each the engaging members has the upper portion inserted in the first section and has the neck portion restricted in the second sections of the guide slot.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
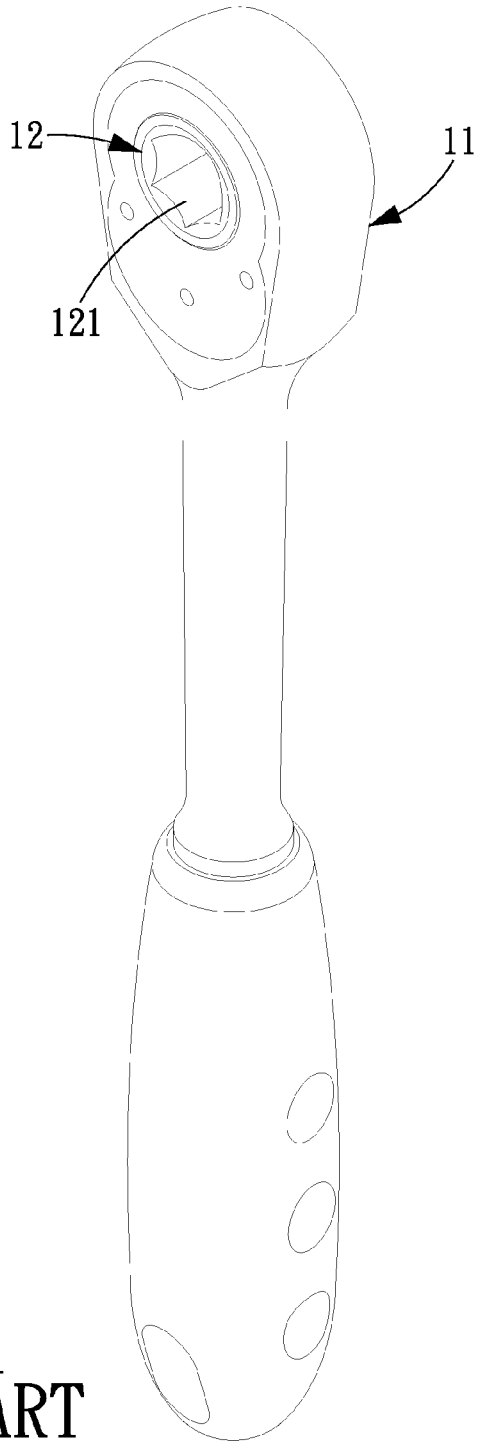
FIG. 1 PRIOR ART
FIG. 1 is a perspective view of a conventional ratchet wrench.
Figure 2:
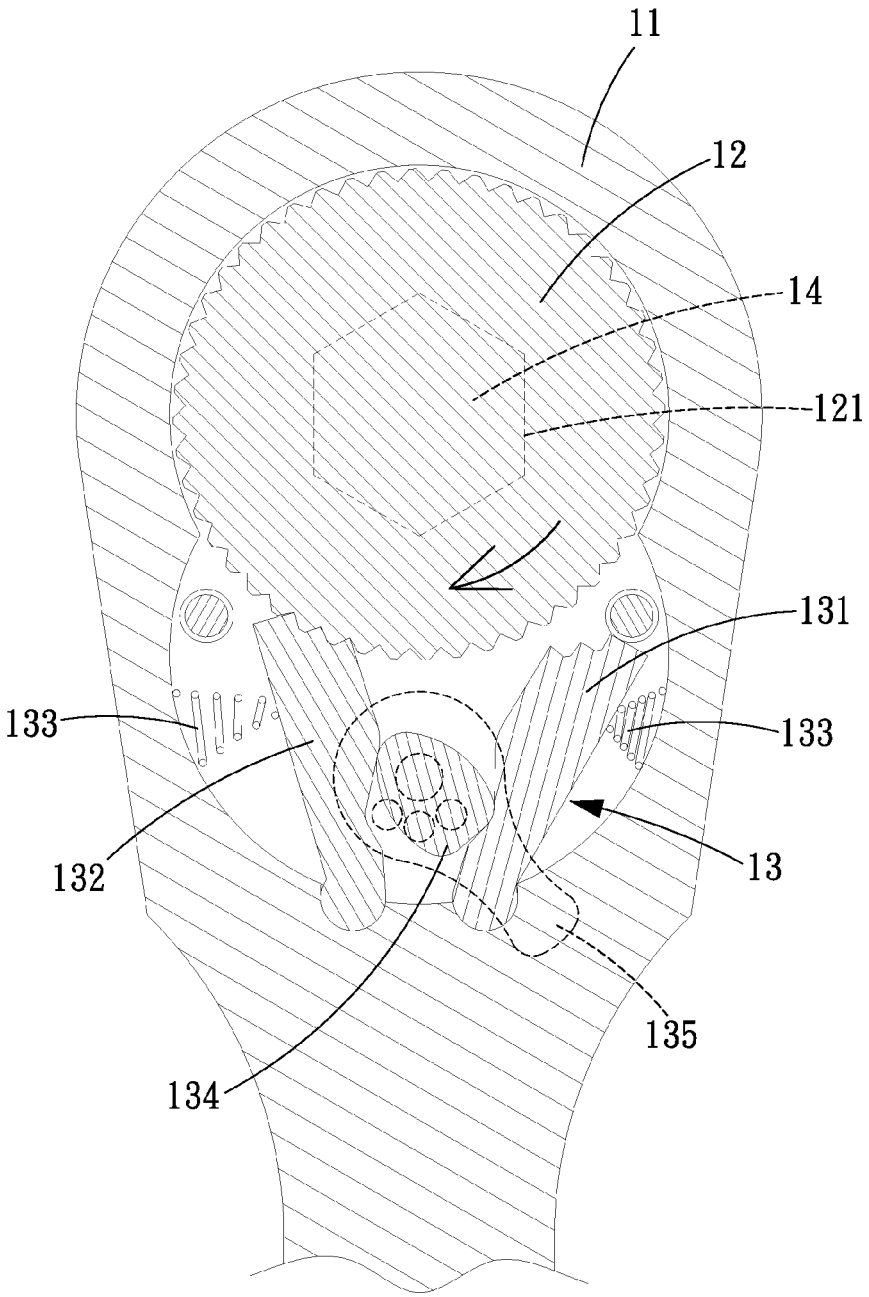
FIG. 2 PRIOR ART
FIG. 2 is a cross sectional view of a part of the conventional ratchet wrench.
Figure 3:
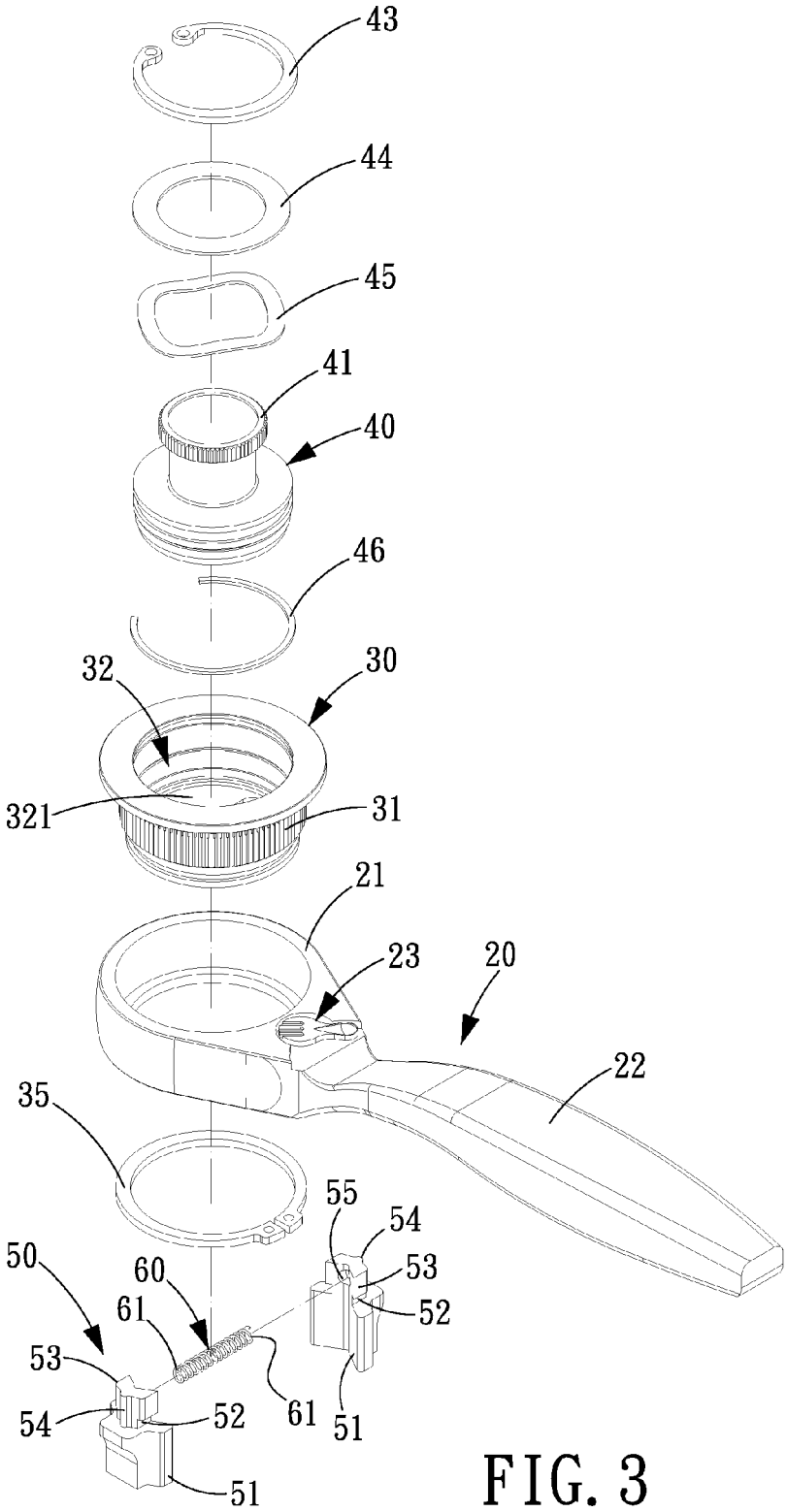
FIG. 3 is an exploded view of a ratchet wrench with adjustable clamping size in accordance with the present invention.
Figure 4:
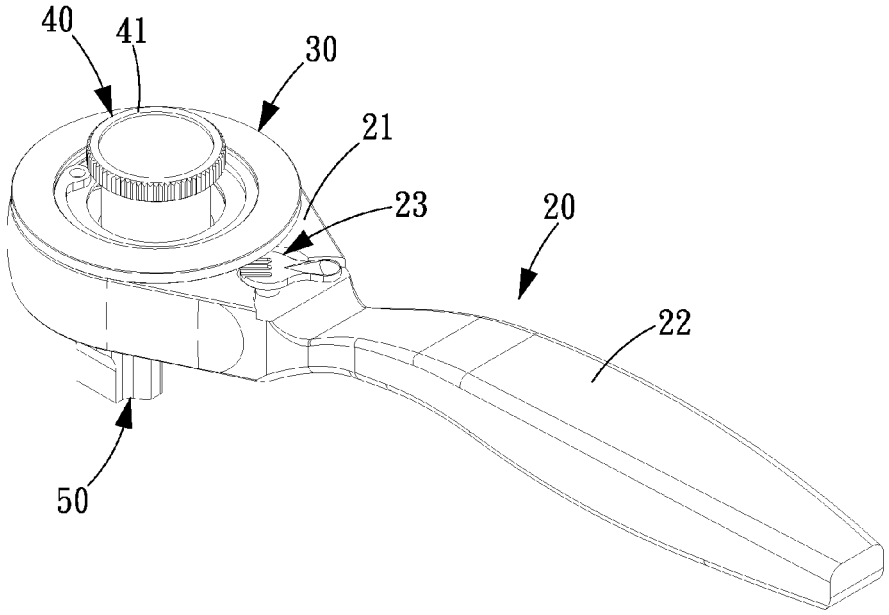
FIG. 4 is an assembly view of the ratchet wrench with adjustable clamping size in accordance with the present invention.
Figure 5:
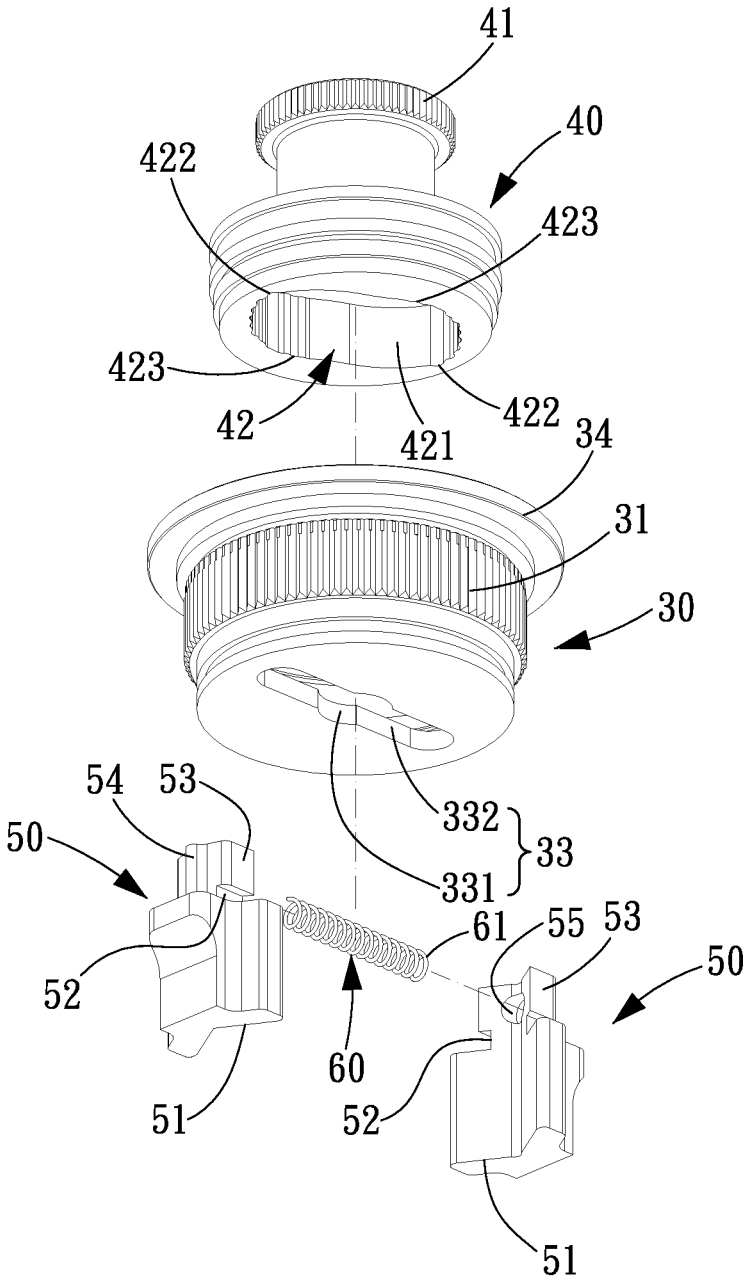
FIG. 5 is an exploded view showing the ratchet wheel, the adjustment member, two engaging members and a spring of the ratchet wrench with adjustable clamping size in accordance with the present invention.
Figure 6:
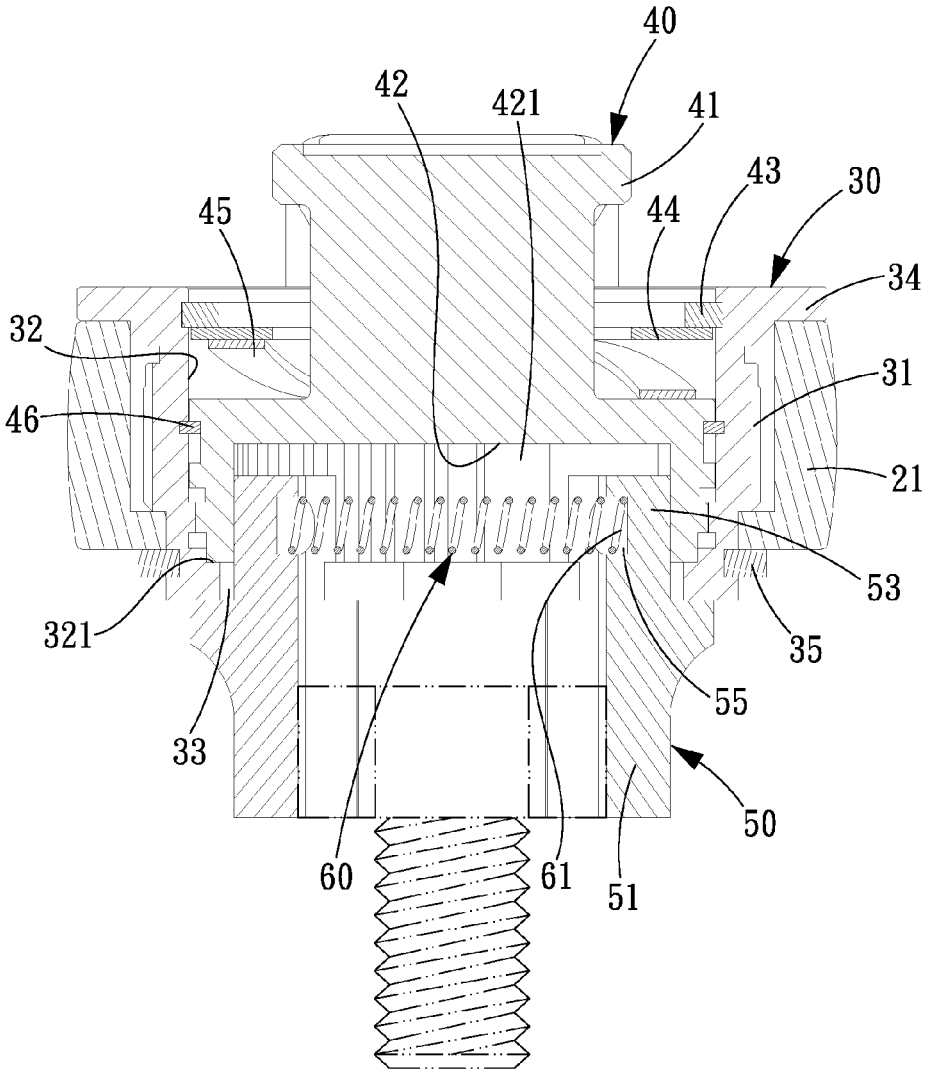
FIG. 6 is a cross sectional view showing that the ratchet wrench of the present invention is adjusted to the first-clamping-size position.
Figure 7:
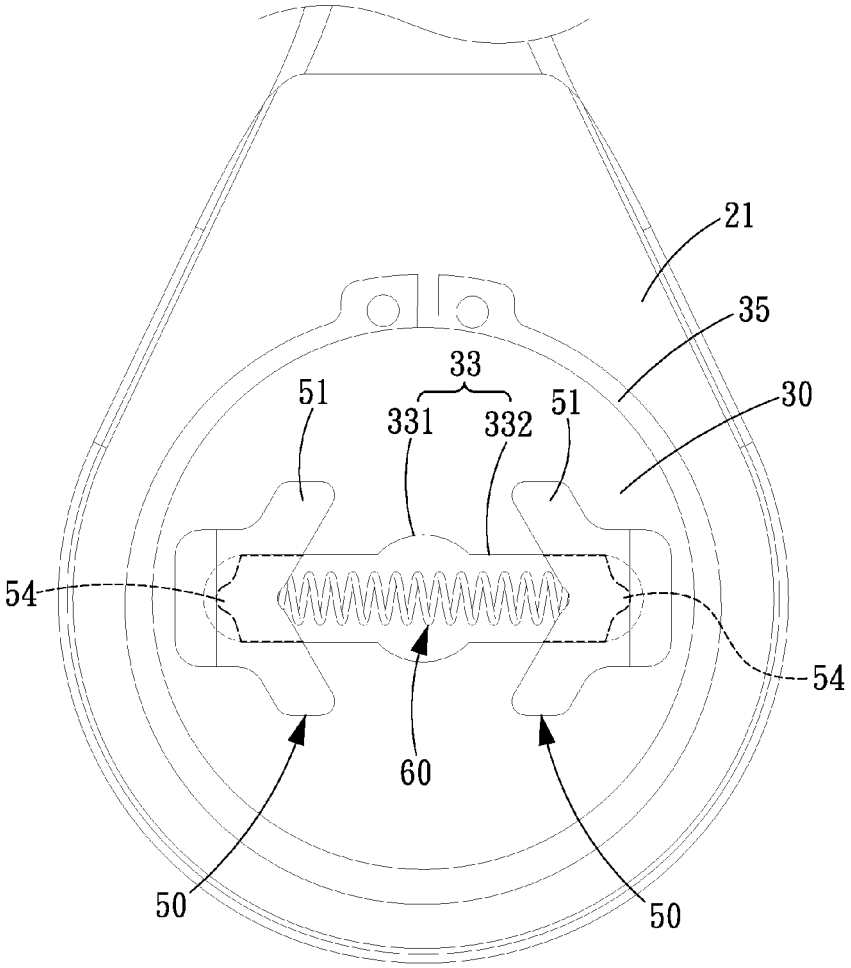
FIG. 7 is a bottom view showing that the ratchet wrench of the present invention is adjusted to the first-clamping-size position.
Figure 8:
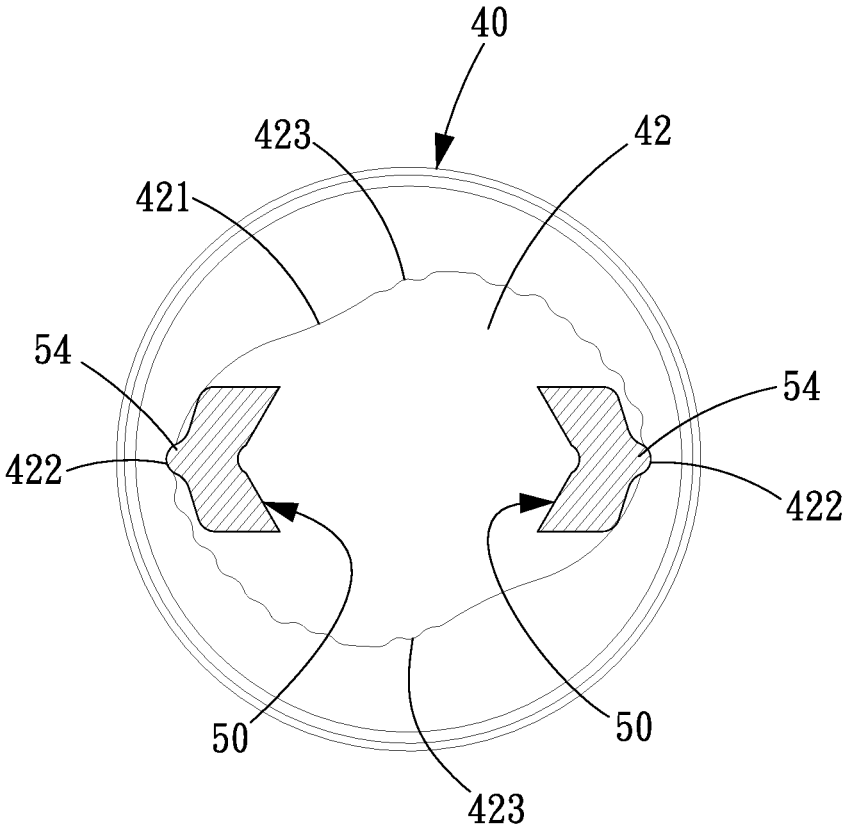
FIG. 8 is another bottom view showing that the ratchet wrench of the present invention is adjusted to the first-clamping-size position.

Referring to FIGS. 3-8, a ratchet wrench with adjustable clamping size in accordance with the present invention is provided with: a body 20 of the ratchet wrench, a ratchet wheel 30, an adjustment member 40, two engaging members 50 and a spring 60, and the ratchet wheel 30, the adjustment member 40, the two engaging members 50 and the spring 60 form a ratchet assembly. It is to be noted that the ratchet wrench described here is a two-way rotation ratchet wrench, and it can also be a one-way rotation ratchet wrench.

The body 20 includes a head portion 21, a handle 22 connected to the head portion 21 and a switch member 23 disposed at the head portion 21. Since the switch member 23 is of a conventional structure and not the key point of the present invention, further description of the switch member 23 is omitted.

The ratchet wheel 30 is pivotally disposed in the head portion 21 and provided with a ratchet portion 31 for engaging with the switch member 23, a pivot cavity 32 with a bottom 321, and a guide slot 33 formed in the bottom 321 of the pivot cavity 32. In this embodiment, the guide slot 33 of the ratchet wheel 30 includes a first section 331 and two second sections 332 which extend from two ends of the first section 331 and have a diameter smaller that the diameter of the first section 331. The ratchet wheel 30 has an annular flange 34 formed at one end thereof to abut against the head portion 21, and another end of the ratchet wheel 30 is pivotally fixed in the head portion 21 by a first C-shaped retainer 35.

The adjustment member 40 is pivotally disposed in the pivot cavity 32 and includes a rotating portion 41 and a non-circular adjustment cavity 42 located toward the guide slot 33. In this embodiment, the adjustment member 40 is further provided on an inner surface 421 thereof with two opposite first engaging grooves 422 and two opposite second engaging grooves 423 in such a manner that a distance between the two first engaging grooves 422 is larger than the distance between the second engaging grooves 423. The adjustment member 40 is pivotally positioned in the pivot cavity 32 of the ratchet wheel 30 by a second C-shaped retainer 43, a flat washer 44, a wave spring washer 45 and a C-ring 46.

The two engaging members 50 are oppositely provided on the ratchet wheel 30 and the adjustment member 40 and each include an engaging portion 51, a neck portion 52 which is connected to the engaging portion 51 and located in the guide slot 33 of the ratchet wheel 30, and an upper portion 53 connected to the neck portion 52 and located in the adjustment cavity 42 of the adjustment member 40. The upper portion 53 is to be engaged with the inner surface 421 of the adjustment cavity 42. In this embodiment, each of the engaging members 50 is further provided with a protrusion 54 which is formed on an outer surface of each of the upper portions 53 to selectively engage with the first engaging grooves 422 or the second engaging grooves 423, and a receiving cavity 55 formed on an inner surface of each of the upper portions 53. To assemble the engaging members 50 (for easy explanation, only one engaging member is described here), the upper portion 53 is inserted in the first section 331 of the guide slot 33 in such a manner that the neck portion 52 is aligned with the second sections 332, and then the engaging member 50 is moved to the second sections 332 to restrict the neck portion 52 in the second sections 332, meanwhile, the guide slot 33 is located between the upper portion 52 and the engaging portion 51, and thus the assembly of the engaging members 50 is completed.

The spring 60 is disposed between the upper portions 53 of the two engaging members 50 in such a manner that the protrusions 54 are engaged with the first engaging grooves 422 or the second engaging grooves 423. In this embodiment, the spring 60 is a compressed spring with two ends 61 inserted in the receiving cavities 55.

The above is the structure of the present invention, as for the operation and function of the preferred embodiment of the present invention, reference should be made to the description below.

The ratchet wrench of the present invention is at least capable of providing two different clamping sizes.

The first clamping size: the two engaging members 50 is pushed by the spring 60 to make the protrusions 54 engaged in the two first engaging grooves 422 of the adjustment member 40, so that the engaging portions 51 of the two engaging members 50 are located a first clamping distance from each other, and at this moment, the ratchet wrench is suitable for clamping and rotating a bolt 71 of a first size.

Figure 9:
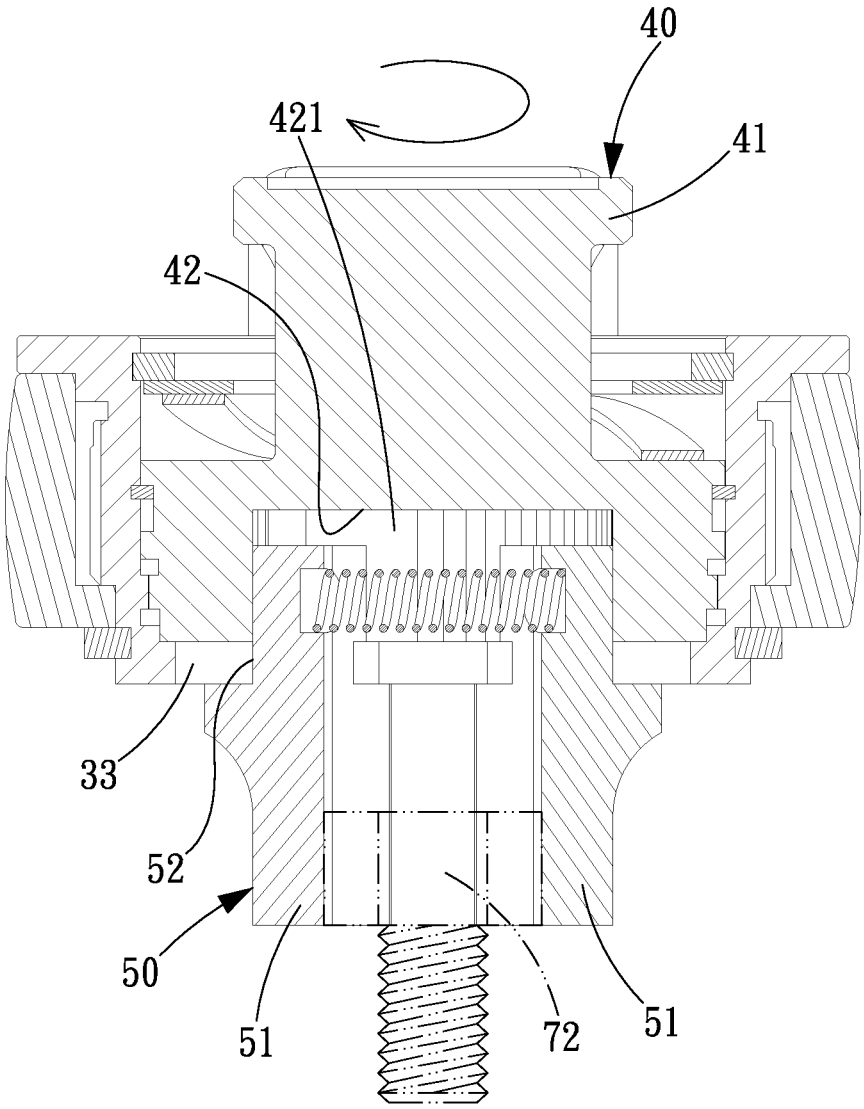
FIG. 9 is a cross sectional view showing that the ratchet wrench of the present invention is adjusted to the first-clamping-size position.
Figure 10:
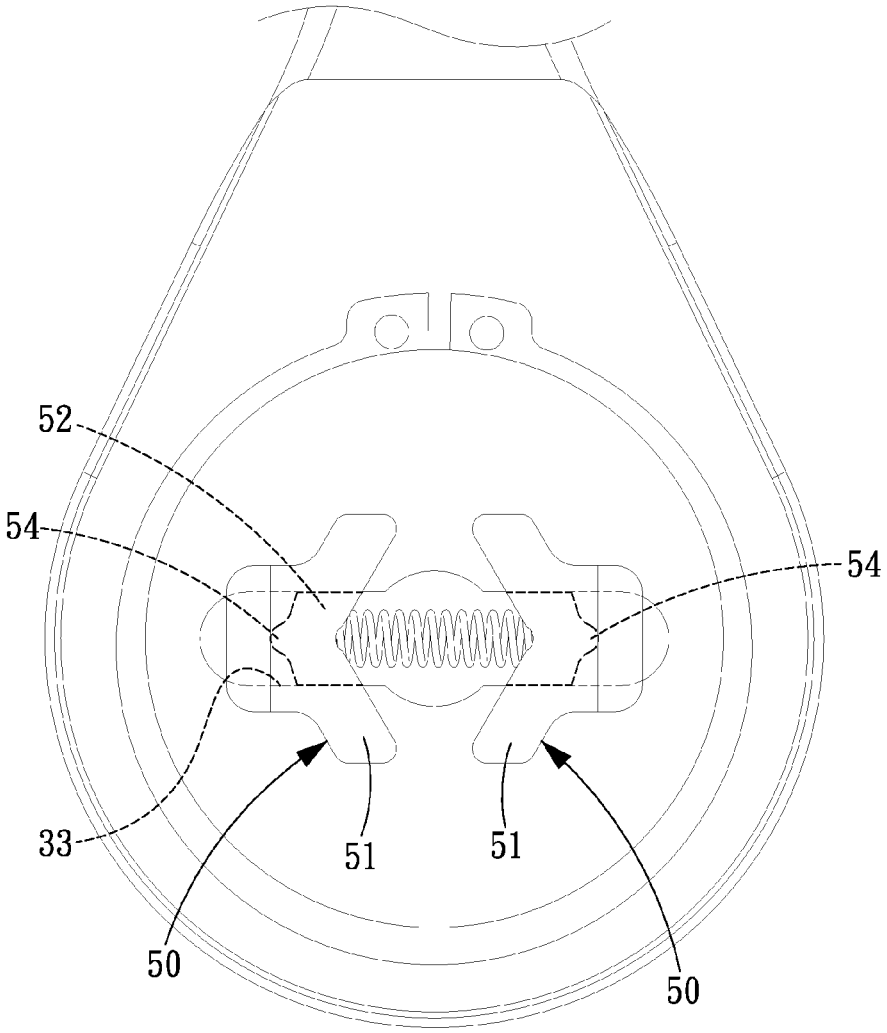
FIG. 10 is a bottom view showing that the ratchet wrench of the present invention is adjusted to the second-clamping-size position.
Figure 11:
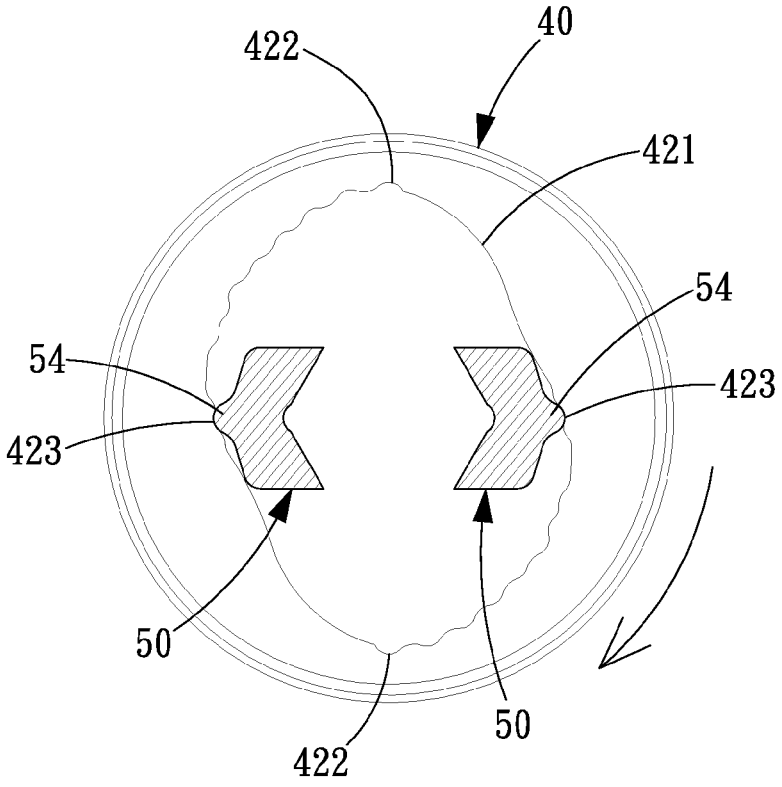
FIG. 11 is another cross sectional view showing that the ratchet wrench of the present invention is adjusted to the second-clamping-size position.

The second clamping size: as shown in FIGS. 8-11, rotating the rotating portion 41 of the adjustment member 40 can make the adjustment cavity 42 rotate. At this moment, the neck portions 52 of the two engaging members 50 are restricted in the guide slot 33 of the ratchet wheel 30, therefore, the engaging members 50 will be caused to move toward or away from each other by moving along the inner surface 421 of the adjustment member 40. When the protrusions 54 of the two engaging members 50 are disengaged from the two first engaging grooves 422 and engaged with the two second engaging grooves 423, the engaging portions 51 of the two engaging members 50 are located a second clamping distance from each other, and this second clamping distance is different from (namely, smaller than) the first clamping distance, at this moment, the ratchet wrench of the present invention is suitable for clamping and rotating a bolt 72 of a second size.

By such arrangements, rotating the rotating portion 41 of the adjustment member 40 can adjust the relative positions of the upper portions 53 of the two engaging members 50 in the adjustment cavity 42 of the adjustment member 40, and can make the neck portions 52 of the engaging members 50 to move along the guide slot 33 to change the distance between the two engaging portions 51, so that the ratchet wrench of the present invention is capable of engaging with and rotating a different sized bolts 71, 72.

While we have shown and described various embodiments in accordance with the present invention, it is clear to those skilled in the art that further embodiments may be made without departing from the scope of the present invention.

What is claimed is:

1. A ratchet wrench with adjustable clamping size comprising:

a body of the ratchet wrench including a head portion, a handle connected to the head portion and a switch member disposed at the head portion;

a ratchet wheel pivotally disposed in the head portion and provided with a ratchet portion for engaging with the switch member, a pivot cavity with a bottom, and a guide slot formed in the bottom of the pivot cavity;

an adjustment member pivotally disposed in the pivot cavity and including a rotating portion and a non-circular adjustment cavity located toward the guide slot;

two engaging members oppositely provided on the ratchet wheel and the adjustment member and each including an engaging portion, a neck portion connected to the engaging portion and located in the guide slot of the ratchet wheel, and an upper portion connected to the neck portion and located in the adjustment cavity of the adjustment member, the upper portion being engaged with an inner surface of the adjustment cavity; and a spring disposed between the upper portions of the two engaging members to make the upper portion engaged with an inner surface of the adjustment cavity;

by such arrangements, rotating the rotating portion of the adjustment member adjusts relative positions of the upper portions of the two engaging members in the adjustment cavity of the adjustment member, and makes the neck portions of the engaging members to move along the guide slot so as to change a distance between the two engaging portions.

2. The ratchet wrench with adjustable clamping size as claimed in claim 1, wherein the adjustment member is further provided on the inner surface of the adjustment cavity of the adjustment cavity with two opposite first engaging grooves and two opposite second engaging grooves in such a manner that a distance between the two first engaging grooves is larger than a distance between the second engaging grooves, and each of the engaging members is further provided with a protrusion which is formed on an outer surface of each of the upper portions to selectively engage with the first engaging grooves or the second engaging grooves.

3. The ratchet wrench with adjustable clamping size as claimed in claim 1, wherein each of the engaging members is further provided with a receiving cavity formed on an inner surface of each of the upper portions.

4. The ratchet wrench with adjustable clamping size as claimed in claim 1, wherein the guide slot of the ratchet wheel includes a first section and two second sections which extend from two ends of the first section and have a diameter smaller that a diameter of the first section, each the engaging members has the upper portion inserted in the first section and has the neck portion restricted in the second sections of the guide slot.

5. An adjustable ratchet assembly disposed in a body of a ratchet wrench comprising:

a ratchet wheel pivotally disposed in the body of the ratchet wrench and provided with a pivot cavity with a bottom, and a guide slot formed in the bottom of the pivot cavity;

an adjustment member pivotally disposed in the pivot cavity and including a rotating portion and a non-circular adjustment cavity located toward the guide slot;

two engaging members oppositely located at two opposite sides of the ratchet wheel and the adjustment member and each including an engaging portion, a neck portion connected to the engaging portion and located in the guide slot of the ratchet wheel, and an upper portion connected to the neck portion and located in the adjustment cavity of the adjustment member, the upper portion being engaged with an inner surface of the adjustment cavity; and a spring disposed between the upper portions of the two engaging members to make the upper portion engaged with an inner surface of the adjustment cavity;

by such arrangements, rotating the rotating portion of the adjustment member adjusts relative positions of the upper portions of the two engaging members in the adjustment cavity of the adjustment member, and makes the neck portions of the engaging members to move along the guide slot so as to change a distance between the two engaging portions.

6. The adjustable ratchet assembly as claimed in claim 5, wherein the adjustment member is further provided on the inner surface of the adjustment cavity of the adjustment cavity with two opposite first engaging grooves and two opposite second engaging grooves in such a manner that a distance between the two first engaging grooves is larger than a distance between the second engaging grooves, and each of the engaging members is further provided with a protrusion which is formed on an outer surface of each of the upper portions to selectively engage with the first engaging grooves or the second engaging grooves.

7. The adjustable ratchet assembly as claimed in claim 5, wherein each of the engaging members is further provided with a receiving cavity formed on an inner surface of each of the upper portions.

8. The adjustable ratchet assembly as claimed in claim 5, wherein the guide slot of the ratchet wheel includes a first section and two second sections which extend from two ends of the first section and have a diameter smaller that a diameter of the first section, each the engaging members has the upper portion inserted in the first section and has the neck portion restricted in the second sections of the guide slot.

9. The adjustable ratchet assembly as claimed in claim 5, wherein the body of the ratchet wrench includes a head portion, a handle connected to the head portion and a switch member disposed at the head portion, and the ratchet wheel is provided with a ratchet portion for engaging with the switch member.

* * * * *